US010971803B2

(12) United States Patent
Bane et al.

(10) Patent No.: US 10,971,803 B2
(45) Date of Patent: Apr. 6, 2021

(54) OMNIDIRECTIONAL ANTENNA SYSTEM FOR MACRO-MACRO CELL DEPLOYMENT WITH CONCURRENT BAND OPERATION

(71) Applicant: CISCO TECHNOLOGY, INC., San Jose, CA (US)

(72) Inventors: Danielle Bane, Cleveland, OH (US); John Martin Blosco, Norton, OH (US); Jonathan Michael Cyphert, Ravenna, OH (US); Benjamin Thomas Pleso, Fairlawn, OH (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 16/540,424

(22) Filed: Aug. 14, 2019

(65) Prior Publication Data

US 2021/0050654 A1 Feb. 18, 2021

(51) Int. Cl.

| | |
|---|---|
| ***H01Q 1/24*** | (2006.01) |
| ***H01Q 1/52*** | (2006.01) |
| ***H01Q 21/06*** | (2006.01) |
| ***H01Q 1/48*** | (2006.01) |
| ***H01Q 5/30*** | (2015.01) |

(52) U.S. Cl.

CPC ..... *H01Q 1/246* (2013.01); *H01Q 1/48* (2013.01); *H01Q 1/521* (2013.01); *H01Q 5/30* (2015.01); *H01Q 21/062* (2013.01)

(58) Field of Classification Search

CPC ..... H01Q 1/243; H01Q 5/10

USPC ..... 343/702, 718, 726, 727, 703, 793, 742; 370/297; 455/101, 450, 75, 437

See application file for complete search history.

(56) References Cited

U.S. PATENT DOCUMENTS

| | | | | |
|---|---|---|---|---|
| 8,963,793 | B2 | 2/2015 | Saliga | |
| 10,111,206 | B2 | 10/2018 | Desai | |
| 2010/0222106 | A1* | 9/2010 | Wang | H04B 7/0686 455/562.1 |
| 2015/0091759 | A1* | 4/2015 | Akhoondzadehasl | H01Q 21/00 343/700 MS |
| 2016/0043478 | A1* | 2/2016 | Hartenstein | H01Q 1/2291 343/835 |
| 2016/0294063 | A1 | 10/2016 | McGough | |
| 2017/0324153 | A1 | 11/2017 | McGough | |
| 2018/0166782 | A1* | 6/2018 | Farzaneh | H01Q 21/26 |
| 2019/0253984 | A1* | 8/2019 | Cariou | H04W 52/367 |

* cited by examiner

*Primary Examiner* — Kiet M Doan

(74) *Attorney, Agent, or Firm* — Cindy Kaplan

(57) ABSTRACT

In one embodiment, an apparatus includes a first omnidirectional antenna for coupling to a first radio to establish a first macro cell and a second omnidirectional antenna for coupling to a second radio to establish a second macro cell. The first and second omnidirectional antennas are configured for concurrent 5 GHz radio operation while maintaining at least 40 dB of isolation between the first and second omnidirectional antennas. An antenna system and network device are also disclosed herein.

20 Claims, 9 Drawing Sheets

OMNIDIRECTIONAL ANTENNA SYSTEM FOR MACRO-MACRO CELL DEPLOYMENT WITH CONCURRENT BAND OPERATION

TECHNICAL FIELD

The present disclosure relates generally to wireless communications systems, and more particularly, to antenna systems for wireless communications systems.

BACKGROUND

Conventional wireless access points (APs) allow for simultaneous operation in different bands (e.g., one in 2.4 GHz band and one in 5 GHz band). However, these APs typically experience degraded performance when two co-located radios operate within the same band (e.g., two radios operating in the 5 GHz band).

BRIEF DESCRIPTION OF THE DRAWINGS

Corresponding reference characters indicate corresponding parts throughout the several views of the drawings.

DESCRIPTION OF EXAMPLE EMBODIMENTS

Overview

Figure 1:
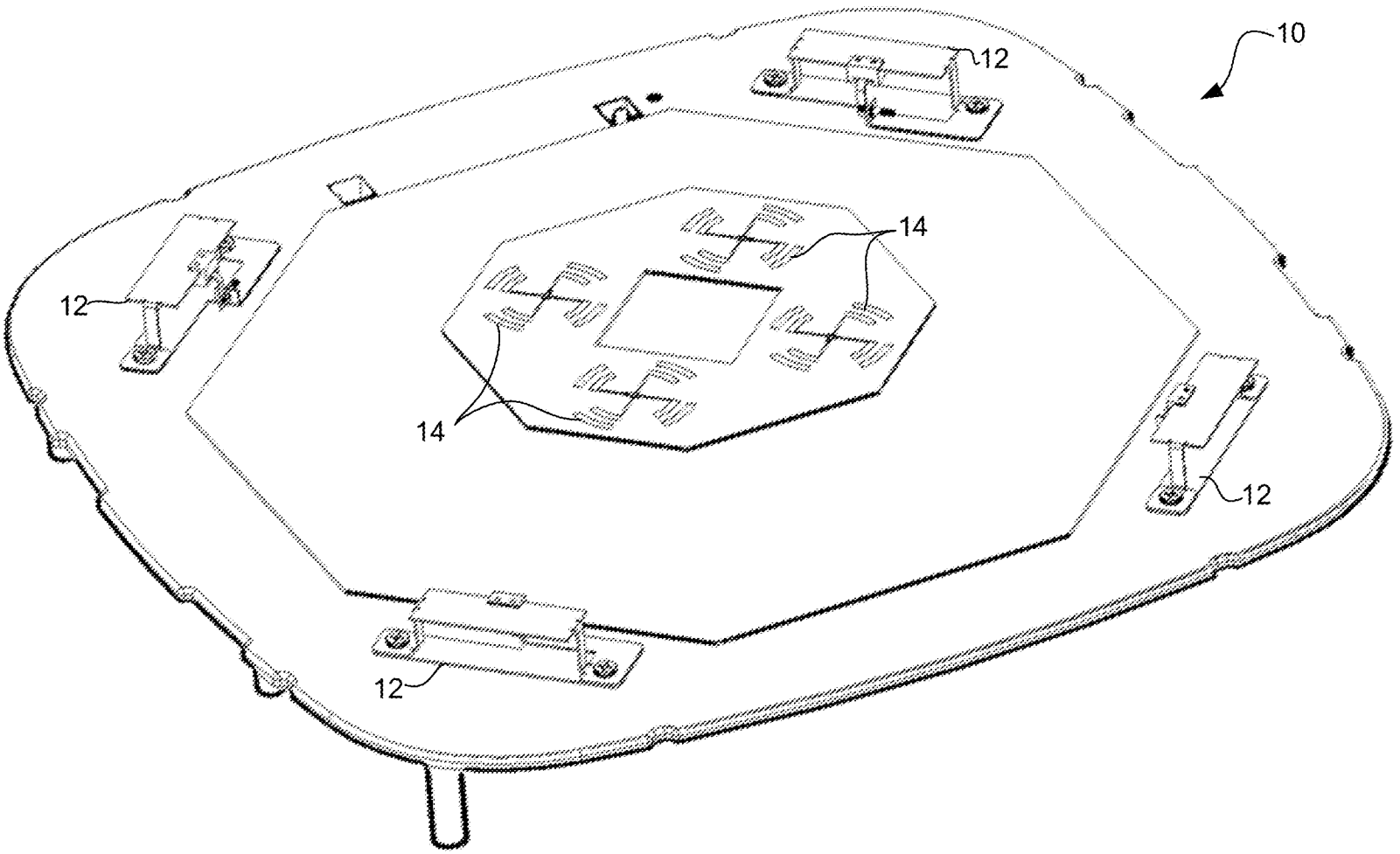
FIG. 1 is a perspective of an antenna system, in accordance with one embodiment.

In one embodiment, an apparatus generally comprises a first omnidirectional antenna for coupling to a first radio to establish a first macro cell and a second omnidirectional antenna for coupling to a second radio to establish a second macro cell. The omnidirectional antennas are configured for concurrent 5 GHz radio operation while maintaining at least 40 dB of isolation between the omnidirectional antennas.

In one or more embodiments, the first antenna is vertically polarized and the second antenna is horizontally polarized.

In one or more embodiments, the first antenna comprises a plurality of dual-band monopole antennas.

In one or more embodiments, the second antenna comprises a plurality of single-band dipole antennas.

In one or more embodiments, the first antenna comprises a plurality of monopole antennas surrounding the second antenna comprising a plurality of dipole antennas.

In one or more embodiments, the second antenna is operable to support up to 7.125 GHz radio operation.

In one or more embodiments, the first antenna is configured for radio operation at 2.4 GHz and 5 GHz.

In one or more embodiments, the first antenna comprises two radiating metal members coupled through a dielectric element.

In one or more embodiments, the first antenna comprises a dielectric element electromagnetically coupling two metal members. One of the metal members may comprise shorting pins coupled to a ground element.

In one or more embodiments, the second antenna is on a double sided printed circuit board and comprises four dipoles arranged in a concentric circle.

In one or more embodiments, the second antenna comprises a plurality of dipoles with a bent dipole design and parasitic elements positioned radially outward from the dipoles.

In one or more embodiments, the first radio comprises a 5 GHz radio and the second radio comprises a dual-band radio.

In another embodiment, an antenna system generally comprises a vertically polarized omnidirectional monopole antenna for coupling to a first radio to establish a first macro cell and a horizontally polarized omnidirectional dipole antenna for coupling to a second radio to establish a second macro cell. The antenna system is configured for concurrent 5 GHz radio operation.

In yet another embodiment, a network device generally comprises a first omnidirectional antenna, a first radio coupled to the first omnidirectional antenna to establish a first macro cell, a second omnidirectional antenna, and a second radio coupled to the second omnidirectional antenna to establish a second macro cell. The network device is configured for concurrent 5 GHz radio operation while maintaining at least 40 dB of isolation between the first and second omnidirectional antennas.

Further understanding of the features and advantages of the embodiments described herein may be realized by reference to the remaining portions of the specification and the attached drawings.

Example Embodiments

The following description is presented to enable one of ordinary skill in the art to make and use the embodiments. Descriptions of specific embodiments and applications are provided only as examples, and various modifications will be readily apparent to those skilled in the art. The general principles described herein may be applied to other applications without departing from the scope of the embodiments. Thus, the embodiments are not to be limited to those shown, but are to be accorded the widest scope consistent with the principles and features described herein. For purpose of clarity, details relating to technical material that is known in the technical fields related to the embodiments have not been described in detail.

Conventional wireless access points (APs) allow for simultaneous operation in different bands (e.g., one in the 2.4 GHz band and one in the 5 GHz band). With the additional spectrum available in 5 GHz and the increasing bandwidth use of Wi-Fi based signals, many access point manufacturers want to add more 5 GHz radios into an AP. However, conventional APs may experience degraded performance when two co-located radios operate within the same band (e.g., two radios operating in the 5 GHz band). Conventional APs that use moderately-directional antennas may help to increase isolation between radios, however, these antennas are generally limited to micro cell or macro-micro cell deployment.

The embodiments described herein provide an antenna system operable to provide macro/macro coverage (macro-macro cell deployment) with sufficient isolation for dual radios to operate simultaneously in the same bandwidth without interference. In one or more embodiments, the antenna system provides macro-macro concurrent 5 GHz radio operation. One or more of the antennas may be capable of covering up to 7.125 GHz in anticipation of the 5 GHz band expansion. In one or more embodiments, the antenna system may maintain at least 40 dB of isolation at 5 GHz (e.g., from 5.15-5.85 GHz) between the two radios. Although a 5 GHz band is described herein, the antennas may facilitate communication in other bandwidths. As described in detail below, the antenna system may include a plurality of dual-band, vertically polarized, omnidirectional monopole antennas and a plurality of single-band, horizontally polarized, omnidirectional dipole antennas.

In one or more embodiments, an apparatus comprises a first omnidirectional antenna for coupling to a first radio to establish a first macro cell and a second omnidirectional antenna for coupling to a second radio to establish a second macro cell. In one or more embodiments, an antenna system comprises a vertically polarized omnidirectional monopole antenna for coupling to the first radio to establish the first macro cell and a horizontally polarized omnidirectional dipole antenna for coupling to the second radio to establish the second macro cell. In one or more embodiments, a network device (e.g., access point) comprises a first omnidirectional antenna, the first radio coupled to the first omnidirectional antenna and configured to establish the first macro cell, and a second omnidirectional antenna, the second radio coupled to the second omnidirectional antenna and configured to establish the second macro cell. In one or more embodiments, the antenna system is configured for concurrent 5 GHz radio operation while maintaining at least 40 dB of isolation between the radios.

As previously noted, the radios are configured to operate concurrently in a macro-macro cell deployment. The macro cell is a coverage area that allows a client device to associate or connect to a wireless network provided by the AP. The macro cell designates a coverage area that is spatially larger than a coverage area established by a micro cell. The co-located same-band radios described herein may operate in the same relative coverage area size, as described below with respect to FIG. 8. Polarization diversity may be used between antennas where the antennas for one macro cell are vertically polarized and antennas for the other macro cell are horizontally polarized, as described below.

Referring now to the drawings and first to FIG. 1, an example of an antenna system 10 is shown, in accordance with one embodiment. The antenna system 10 includes two different types of antennas 12, 14 each coupled to a macro cell radio (not shown). The antenna system 10 is configured for omnidirectional radiation patterns, which allows for use in a macro-macro configuration. As previously described, the first radio is coupled to a first antenna, the combination of which establishes the first macro cell and the second radio is coupled to a second antenna, the combination of which establishes the second macro cell. In the example shown in FIG. 1, the first and second antennas each represent a plurality of antennas with different configurations (e.g., first antenna comprises vertically polarized monopole antennas 12 and second antenna comprises horizontally polarized dipole antennas 14). For example, the antenna system 10 shown in FIG. 1 comprises four dual-band monopole antennas 12 (first antenna) positioned radially outward from and generally surrounding four single-band dipole antennas 14 (second antenna) equally spaced in a circle. It is to be understood that the four monopole antennas 12 may be referred to collectively as the antenna. Similarly, the four dipole antennas 14 may also be collectively referred to as an antenna. Furthermore, it is to be understood that the arrangement shown in FIG. 1 is only an example and the antenna system may comprise any number of monopole or dipole antennas in any suitable arrangement.

Figure 2:
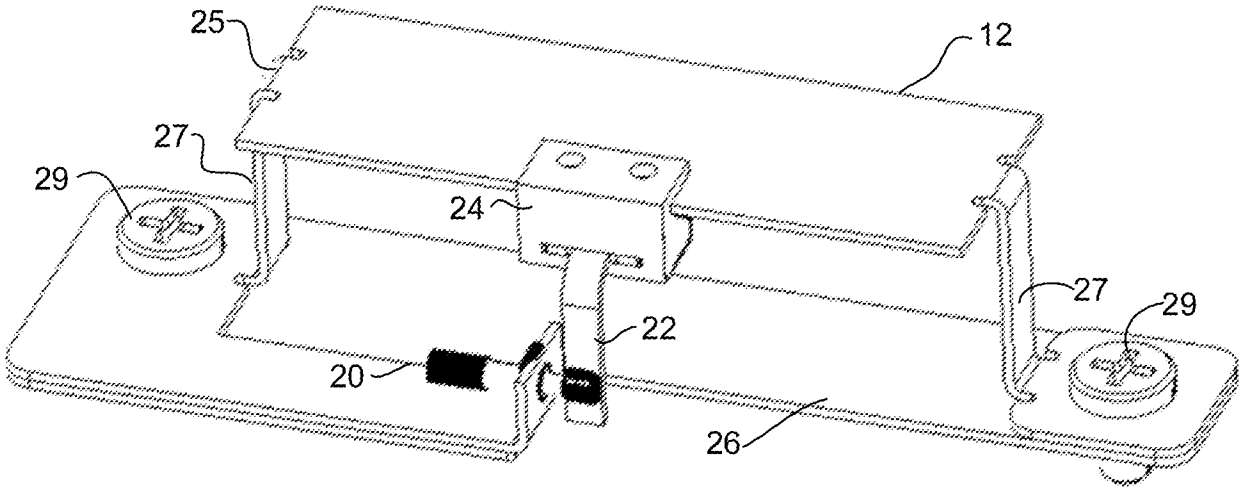
FIG. 2 is a perspective of a dual-band monopole antenna of the antenna system shown in FIG. 1, in accordance with one embodiment.

FIG. 2 illustrates additional details of the antenna 12, in accordance with one embodiment. In one or more embodiments, a 5 GHz only radio is connected to the dual-band monopole antenna 12. In one example, the dual-band antenna 12 may operate in the 2.4 and 5 GHz Wi-Fi bands. As shown in FIG. 2, the antenna 12 comprises two radiating metal members (pieces) 22, 25 held together by a dielectric element 24, which is used to electromagnetically couple the two pieces of metal together. A center conductor of a coaxial cable 20 is soldered to a lower portion of the bent metal member 22 (as viewed in FIG. 2), which may operate as a 5 GHz monopole antenna, for example. An outer conductor of the cable 20 is coupled to a ground element 26 while the inner conductor of the coaxial cable is connected to the feed. The coaxial cable 20 may include an outer shield. At 5 GHz, the shorter metal piece 22 operates as a 5 GHz quarter wavelength monopole antenna. At 2.4 GHz, the dielectric element 24 electromagnetically couples the shorter metal piece 22 to the taller metal member 25 forming a quarter wavelength monopole. An upper portion of the bent metal piece 22 snaps into the dielectric element 24. The taller metal member 25 snaps into the same dielectric element 24, which operates as a coupler. The taller metal member 25 consists of two shorting pins 27 symmetrically placed around the feed. In the example shown in FIG. 2, tabs of the metal member 25 are bent to form the shorting pins 27, which are coupled to the ground plane 26. The shorting pins 27 are connected to the ground element 26 through connectors 29. The shorting pins 27 may be coupled to the ground plane using any appropriate means, such as screws, rivets, solder, etc. The shorting pins 27 induce a circulating magnetic field that induces a perpendicular electric field thus creating a vertically polarized monopole antenna at 2.4 GHz. The design provides a reduced footprint, thereby enabling a reduction in overall size of the antenna system.

Figure 3A:
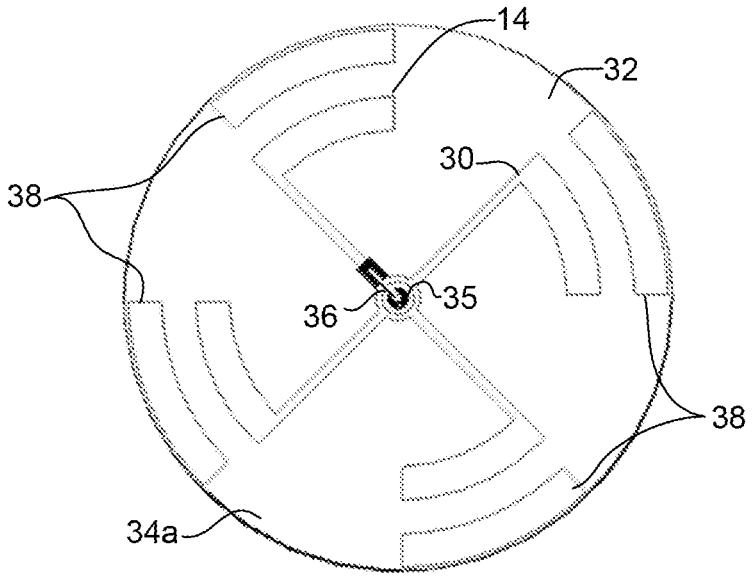
FIG. 3A is a top view of a single-band dipole antenna of the antenna system of FIG. 1, in accordance with one embodiment.
Figure 3B:
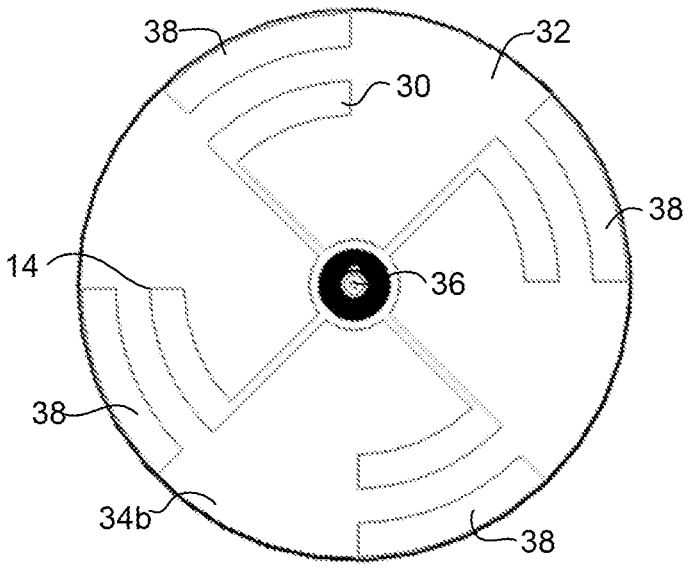
FIG. 3B is a bottom view of the antenna of FIG. 3A.
Figure 3C:
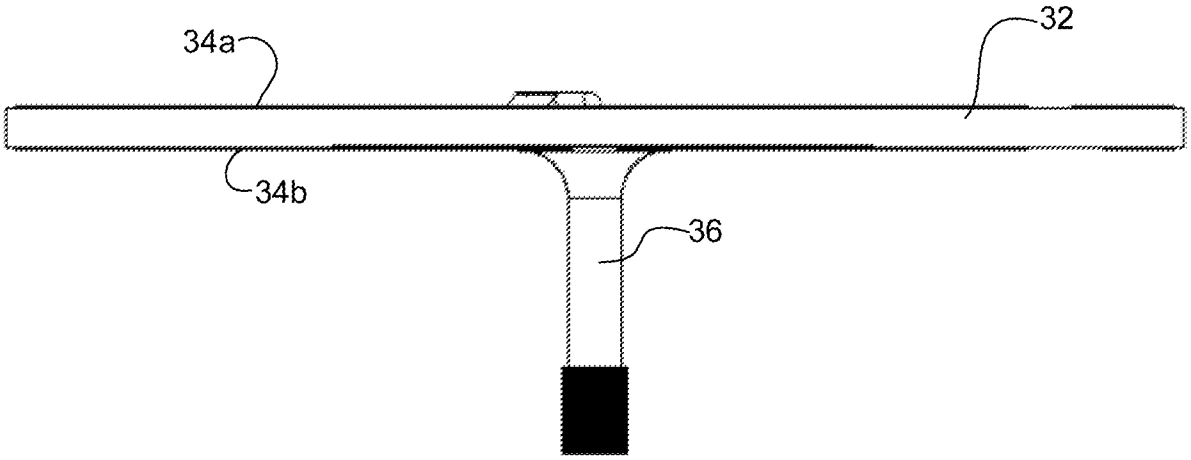
FIG. 3C is a side view of the antenna of FIG. 3A.

FIGS. 3A, 3B, and 3C illustrate a top view, bottom view, and side view, respectively, of the second antenna 14. A dual-band radio (XOR radio for flexible band radio architecture) may be connected to the horizontally polarized, omnidirectional antenna at 5 GHz. In one or more embodiments, the antenna 14 comprises four dipoles 30 equally spaced in a circle on a double sided printed circuit board (PCB) 32 (FIGS. 1 and 3A). The four dipoles 30 are arranged in a concentric circle with radiating element on an upper side 34*a* (top shown in FIG. 3A) and grounding on a lower side 34*b* (bottom shown in FIG. 3B).

It is to be understood that the terms top, bottom, upper, and lower as used herein are relative terms dependent on the position of the antenna and network device and are not to be interpreted as limiting the embodiments to any particular orientation or arrangement.

The radiating elements (of the dipoles 30) located on the top (front) side 34*a* of the PCB 32 are connected at a center 35 of the PCB. The ground for each of the dipoles 30 is connected at the center of the bottom (back) side 34*b* of the board 32. A coaxial cable 36 enters through the center of the board 32 with a shield soldered to a center ground point on the back (FIGS. 3B and 3C) and the center conductor soldered to the top center point of the radiating elements (FIG. 3A). This arrangement provides for a horizontally polarized, omnidirectional antenna to be used for a macro-macro concurrent 5 GHz radio operation.

The bent dipole design shown in FIGS. 3A and 3B reduces the size and allows for use of parasitic elements 38 to extend the bandwidth (e.g., from 5.85 GHz to 7.125 GHz). As shown in FIGS. 3A and 3B, the parasitic elements 38 comprise floating metal pieces positioned radially outward from the dipole ring, which couple to the dipoles 30 to help increase the bandwidth. The parasitic elements 38 may be oriented around the radiating elements to increase the bandwidth up to 7.125 GHz, for example, in anticipation of the 5 GHz band extension from 5.85 GHz to 7.125 GHz. The dipole based design provides omnidirectional coverage rather than directional coverage.

Figure 4:
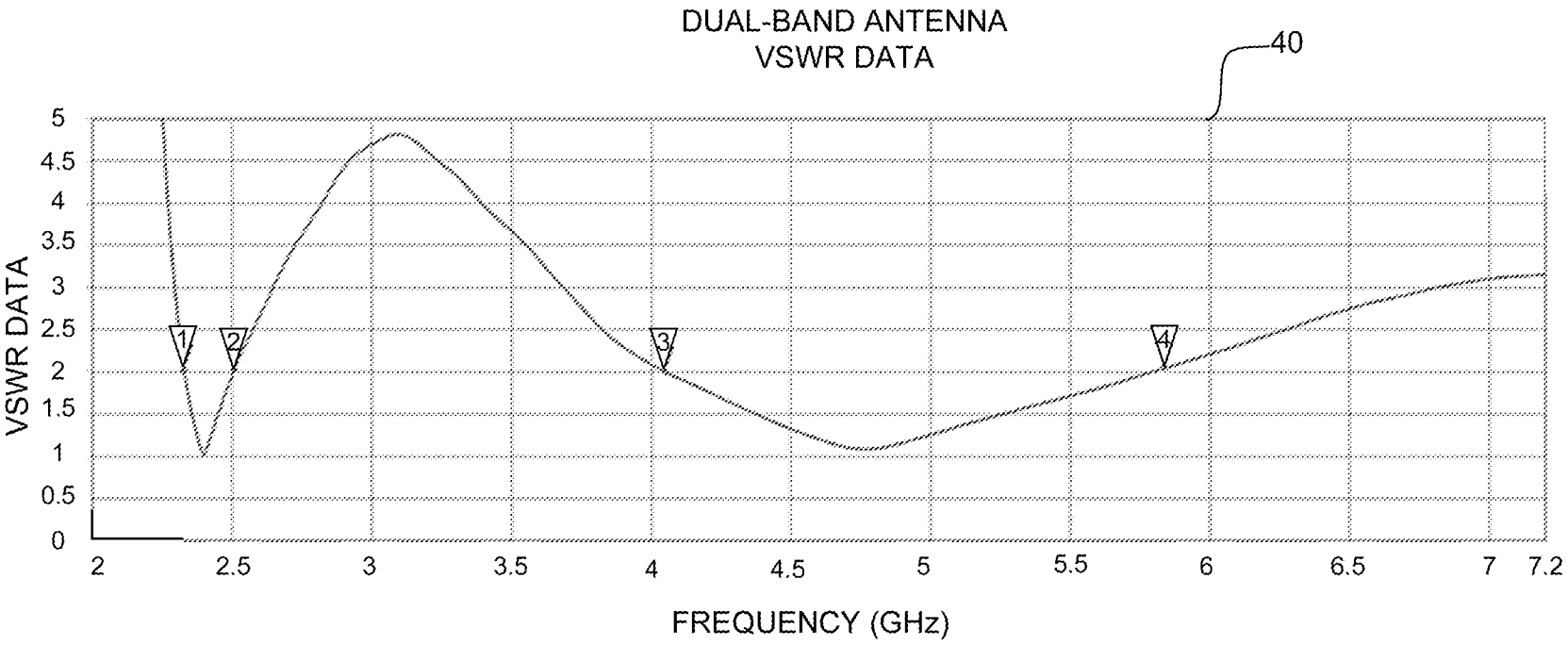
FIG. 4 illustrates VSWR (Voltage Standing Wave Ratio) data for the antenna of FIG. 2, in accordance with one embodiment.
Figure 5:
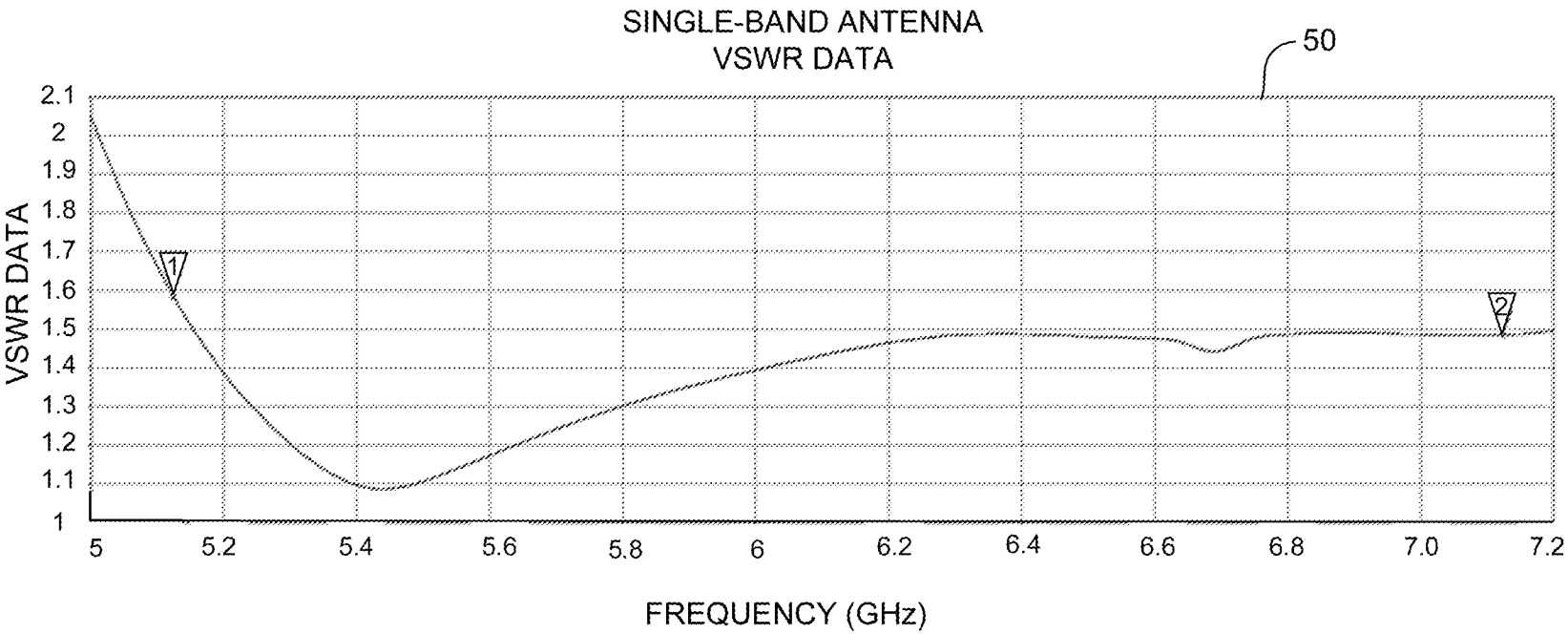
FIG. 5 illustrates VSWR data for the antenna of FIG. 3A, in accordance with one embodiment.

FIG. 4 illustrates an example of VSWR (Voltage Standing Wave Ratio) values for the dual-band antenna of FIG. 2 and FIG. 5 illustrates an example of VSWR values for the single-band antenna of FIGS. 3A-3C, in accordance with one embodiment. FIGS. 4 and 5 show graphs 40, 50 of the VSWR of the antennas as a function of frequency (GHz).

Points 1, 2, 3, and 4 are marked on the graph 40 of FIG. 4 to highlight the VSWR at specific frequencies. More specifically, point 1 shows that the antenna has a VSWR of 2.0164 at 2.3276 GHz, point 2 shows a VSWR of 2.0264 at 2.5071 GHz, point 3 shows a VSWR of 2.0001 at 4.0491 GHz, and point 4 shows a VSWR of 2.0433 at 5.8369 GHz.

Points 1 and 2 are marked on the graph 50 of FIG. 5 to highlight the VSWR at specific frequencies. More specifically, point 1 shows that the antenna has a VSWR of 1.5836 at 5.1245 GHz and point 2 shows a VSWR of 1.4845 at 7.1251 GHz.

It is to be understood that the data shown in the graphs of FIGS. 4 and 5 is only an example for a simulation model and other configurations may exhibit different VSWR values over the frequency range shown, without departing from the scope of the embodiments.

Figure 6:
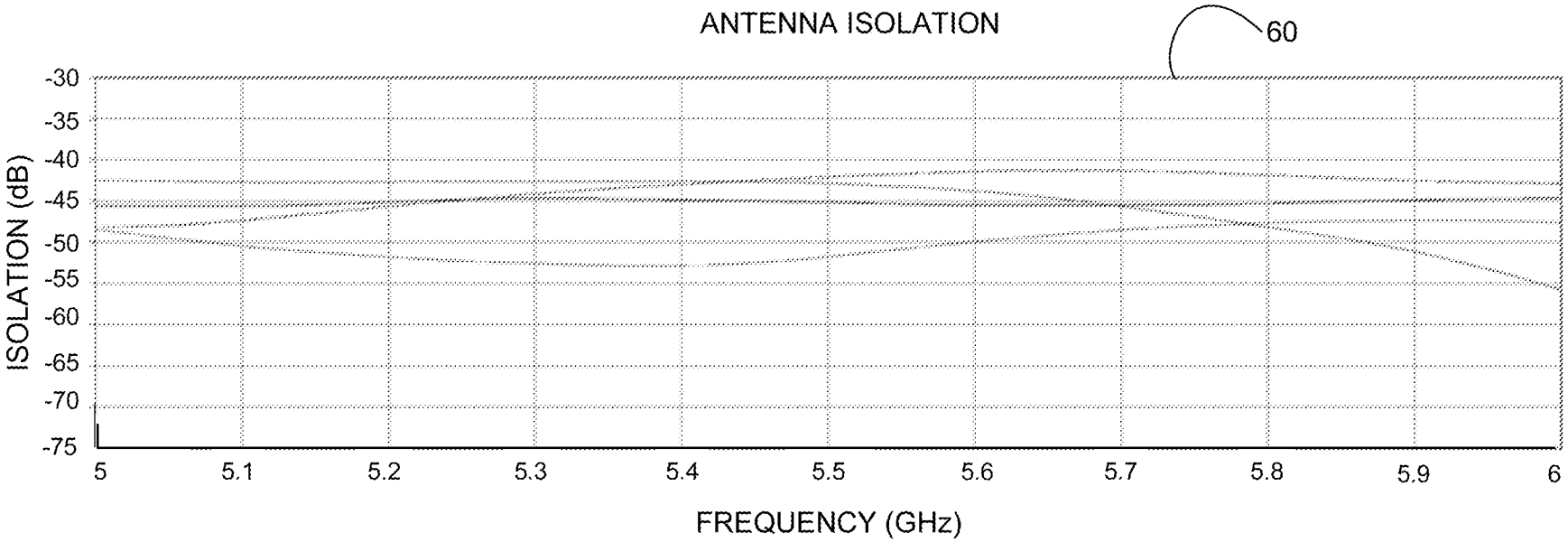
FIG. 6 illustrates isolation between antennas in the antenna system of FIG. 1, in accordance with one embodiment.

FIG. 6 illustrates isolation between the macro cell antennas in the network device, in accordance with one embodiment. A graph 60 in FIG. 6 provides an example of an aggregate plot of the mutual coupling between the macro cell antennas for different signals where the mutual coupling across 5-6 GHz is at least 40 dB between any two macro cell antennas, thereby achieving significant isolation between the macro cell antennas.

Figure 7:
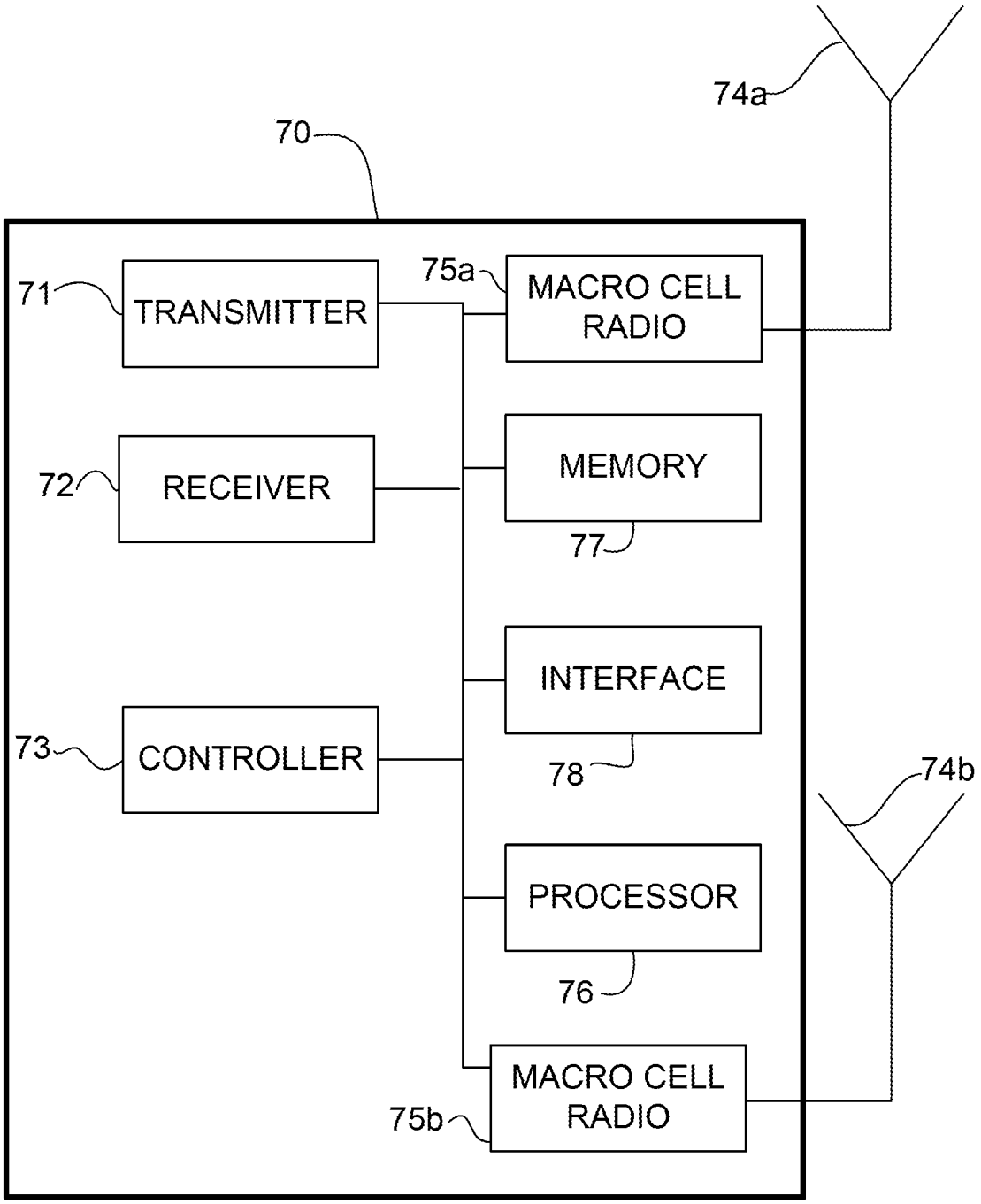
FIG. 7 is a block diagram depicting an example of a network device in which the embodiments described herein may be implemented.

FIG. 7 is a block diagram illustrating an example of a network device 70 (e.g., access point) that may be used to implement embodiments described herein. In one embodiment, the network device 70 is a programmable machine that may be implemented in hardware, software, or any combination thereof. The device 70 includes a transmitter 71, receiver 72, controller (control system) 73, processor 76, memory 77, interface 78, and two macro cell radios 75*a*, 75*b* coupled to antennas 74*a*, 74*b*. The terms transmitter and receiver as used herein may also refer to a transceiver.

The controller (control system) 73 may include various hardware, firmware, and software components used to control the AP 70. For example, the control system 73 may include logic to implement embodiments described herein. The logic may be encoded in one or more tangible media (e.g., memory 77) for execution by the processor 76. For example, the processor 76 may execute codes stored in a computer-readable medium such as memory 77. The logic may be in the form of software executed by the processor, digital signal processor instructions, or in the form of fixed logic in an integrated circuit, for example. The controller 73 may control operation of the macro cell radios 75*a*, 75*b*. For example, in one or more embodiments, the control system 73 may operate the first and second radios 75*a*, 75*b* to operate in a same frequency band (e.g., 5 GHz band).

The system may be configured to implement modulation and framing of signals according to the applicable communication protocol or standard under control of the controller 73. The system may further include a modem for demodulating signals from receivers and modulating transmit signals for transmission, analog-to-digital converters (ADCs), and digital to analog converters (DACs).

Memory 77 may be a volatile memory or non-volatile storage, which stores various applications, operating systems, modules, and data for execution and use by the processor 76. Memory 77 may include multiple memory components.

The interface 78 may include any number of wireless or wired interfaces. For example, the AP 70 may include a network interface for communication with a LAN.

It is to be understood that the network device 70 shown in FIG. 7 and described above is only an example and that different configurations of network devices may be used. For example, the network device 70 may further include any suitable combination of hardware, software, algorithms, processors, devices, components, or elements operable to facilitate the capabilities described herein.

Figure 8:
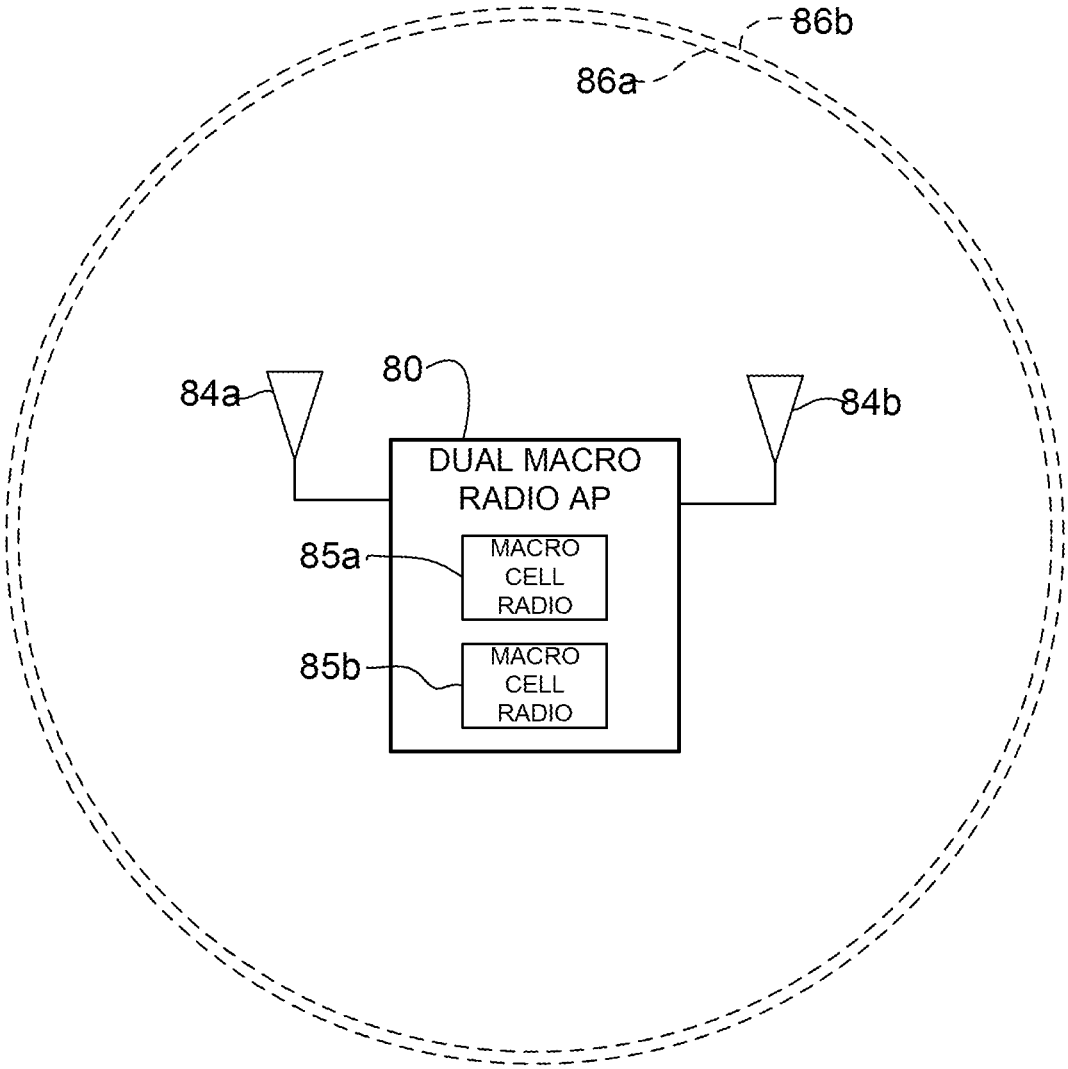
FIG. 8 illustrates an example operating environment of a dual radio access point, in accordance with one embodiment.

FIG. 8 illustrates an example operating environment of a dual macro radio AP 80, in accordance with one embodiment. A first radio 85*a* of the AP 80 is coupled to a first antenna 84*a* and establishes a macro cell with a coverage area 86*a*. A second radio 85*b* of the AP 80 is coupled to a second antenna 84*b* and establishes a macro cell with a coverage area 86*b*. The two concentric circles of coverage around the AP 80 are referred to as macro coverage areas that can both serve clients without interference through use of the antenna system described herein. Those skilled in the art will appreciate that the size, shape, and location of the coverage areas 86*a*, 86*b* may be different in other implementations, with both macro cells 86*a*, 86*b* having a similar size coverage area (i.e., both radios 85*a* and 85*b* providing macro cell coverage). As previously described, in one or more embodiments the first antenna 84*a* comprises a vertically polarized dual-band omnidirectional monopole antenna and the second antenna 84*b* comprises a horizontally polarized single-band omnidirectional dipole antenna with the antennas configured for concurrent 5 GHz radio operation while maintaining at least 40 dB of isolation between the first and second antennas (e.g., from 5.15 GHz to 5.85 GHz) in the macro-macro configuration.

Although the method and apparatus have been described in accordance with the embodiments shown, one of ordinary skill in the art will readily recognize that there could be variations made to the embodiments without departing from the scope of the embodiments. Accordingly, it is intended that all matter contained in the above description and shown in the accompanying drawings shall be interpreted as illustrative and not in a limiting sense.

What is claimed is:

1. An apparatus comprising:

a first omnidirectional antenna for coupling to a first radio to establish a first macro cell; and a second omnidirectional antenna for coupling to a second radio to establish a second macro cell, wherein said first and second radios are configured to operate concurrently in a macro-macro cell deployment;

wherein said first and second omnidirectional antennas are configured for concurrent 5 GHz radio operation while maintaining at least 40 dB of isolation between said first and second omnidirectional antennas; and wherein said first omnidirectional antenna comprises a plurality of dual-band monopole antennas and said second omnidirectional antenna comprises a plurality of single-band dipole antennas.

2. The apparatus of claim 1 wherein said first omnidirectional antenna is vertically polarized and said second omnidirectional antenna is horizontally polarized.

3. The apparatus of claim 1 wherein said plurality of monopole antennas surround a group of said plurality of dipole antennas.

4. The apparatus of claim 1 wherein said second omnidirectional antenna is operable to support up to 7.125 GHz radio operation.

5. The apparatus of claim 1 wherein said first omnidirectional antenna is configured for radio operation at 2.4 GHz and 5 GHz.

6. The apparatus of claim 1 wherein said first omnidirectional antenna comprises two radiating metal members coupled through a dielectric element.

7. The apparatus of claim 1 wherein said first omnidirectional antenna comprises a dielectric element electromagnetically coupling two metal members.

8. The apparatus of claim 7 wherein one of the metal members comprises shorting pins coupled to a ground element.

9. The apparatus of claim 1 wherein said second omnidirectional antenna is on a double sided printed circuit board and comprises four dipoles arranged in a concentric circle.

10. The apparatus of claim 1 wherein said plurality of dipole antennas comprises dipoles with a bent dipole design and parasitic elements positioned radially outward from the dipoles.

11. The apparatus of claim 1 wherein said first radio comprises a 5 GHz radio and said second radio comprises a dual-band radio.

12. The apparatus of claim 1 wherein the single-band dipole antennas are all positioned together in a central location and all of the dual-band monopole antennas are positioned radially outward from and surrounding the single-band dipole antennas.

13. The apparatus of claim 1 wherein said plurality of dual-band monopole antennas and said plurality of single-band dipole antennas each comprise the same number of antennas.

14. An antenna system comprising:

a vertically polarized omnidirectional antenna for coupling to a first radio to establish a first macro cell; and a horizontally polarized omnidirectional antenna for coupling to a second radio to establish a second macro cell;

wherein the antenna system is configured for concurrent 5 GHz radio operation; and wherein said vertically polarized omnidirectional antenna comprises a plurality of monopole antennas and said horizontally polarized omnidirectional antenna comprises a plurality of dipole antennas; and wherein said first and second radios are configured to operate concurrently in a macro-macro cell deployment.

15. The antenna system of claim 14 wherein the monopole antennas are positioned radially outward from the dipole antennas.

16. The antenna system of claim 14 wherein the horizontally polarized omnidirectional dipole antenna is operable to support up to 7.125 GHz radio operation.

17. A network device comprising:

a first omnidirectional antenna;

a first radio coupled to said first omnidirectional antenna to establish a first macro cell;

a second omnidirectional antenna; and a second radio coupled to said second omnidirectional antenna to establish a second macro cell;

wherein the network device is configured for concurrent 5 GHz radio operation while maintaining at least 40 dB of isolation between said first and second omnidirectional antennas;

wherein said first omnidirectional antenna comprises a plurality of dual-band monopole antennas and said second omnidirectional antenna comprises a plurality of single-band dipole antennas; and wherein said first and second radios are configured to operate concurrently in a macro-macro cell deployment.

18. The network device of claim 17 wherein said second omnidirectional antenna is operable to support up to 7.125 GHz radio operation.

19. The network device of claim 17 wherein said first omnidirectional antenna comprises a vertically polarized antenna and second omnidirectional antenna comprises a horizontally polarized antenna.

20. The network device of claim 17 wherein said plurality of monopole antennas surround said plurality of dipole antennas, each of the monopole antennas comprising two radiating metal members coupled together by a dielectric element.

* * * * *